US010233011B1

(12) United States Patent
Estill

(10) Patent No.: US 10,233,011 B1
(45) Date of Patent: Mar. 19, 2019

(54) APPLIANCE PACKAGING SYSTEM AND METHOD

(71) Applicant: Danby Products Limited, Guelph (CA)

(72) Inventor: Jim Estill, Guelph (CA)

(73) Assignee: DANBY PRODUCTS LIMITED, Guelph (CA)

( * ) Notice: Subject to any disclaimer, the term of this patent is extended or adjusted under 35 U.S.C. 154(b) by 0 days.

(21) Appl. No.: 15/584,606

(22) Filed: May 2, 2017

Related U.S. Application Data

(60) Provisional application No. 62/335,274, filed on May 12, 2016.

(51) Int. Cl.

| | |
|---|---|
| ***B65D 85/30*** | (2006.01) |
| ***B65D 19/44*** | (2006.01) |
| ***B65D 5/42*** | (2006.01) |
| ***B65D 5/66*** | (2006.01) |
| ***B65D 5/54*** | (2006.01) |
| ***B65D 81/05*** | (2006.01) |

(52) U.S. Cl.
CPC ..... *B65D 85/30* (2013.01); *B65D 5/4216* (2013.01); *B65D 5/4266* (2013.01); *B65D 5/54* (2013.01); *B65D 5/66* (2013.01); *B65D 19/44* (2013.01); *B65D 81/054* (2013.01); *B65D 2519/0081* (2013.01)

(58) Field of Classification Search
CPC ..... B65D 5/42; B65D 5/4216; B65D 5/4266; B65D 5/64; B65D 5/66; B65D 19/44; B65D 25/22; B65D 81/02; B65D 81/05; B65D 81/054; B65D 85/00; B65D 85/30; B65D 2519/0081; B65D 5/54
USPC ..... 206/320, 386, 497, 586–594, 595–600
See application file for complete search history.

(56) References Cited

U.S. PATENT DOCUMENTS

| | | | | | |
|---|---|---|---|---|---|
| 3,163,290 | A * | 12/1964 | Shive | B65D 5/64 | 206/320 |
| 4,811,840 | A * | 3/1989 | Muyskens | B65D 5/5035 | 206/320 |
| 5,190,089 | A * | 3/1993 | Jackson | D06F 39/001 | 206/320 |
| 5,307,928 | A * | 5/1994 | Bishop | B65D 5/5033 | 206/320 |
| 5,701,999 | A * | 12/1997 | Phillips, II | B65D 75/004 | 206/320 |
| 5,862,911 | A * | 1/1999 | Phillips, II | B65D 75/004 | 206/320 |
| 6,988,615 | B2 * | 1/2006 | Merkel | B65D 81/057 | 206/320 |

(Continued)

*Primary Examiner* — Bryon Gehman
(74) *Attorney, Agent, or Firm* — Ralph E. Jocke; Walker & Jocke

(57) ABSTRACT

A unit package (10) is utilized to hold an appliance (12) such as a microwave oven. The unit package may include an impact absorbing base (14) which supports the appliance. A transparent flexible liner (40) extends in surrounding relation of the appliance. A plurality of straps (44) including respective flexible loops (46) which serve as handles, extend in surrounding relation of the liner, the appliance and the base. A plurality of unit packages are arrangeable in a stack for transport including layers of rows in supported connection with a pallet (52). A sleeve (64) extends in surrounding relation of the stack. Frangible adhesive strips (84, 86) enable opening the sleeve to expose the unit packages.

32 Claims, 8 Drawing Sheets

(56) References Cited

U.S. PATENT DOCUMENTS

| | | | | |
|---|---|---|---|---|
| 7,048,119 | B2 * | 5/2006 | Baechle | B65D 61/00 206/320 |
| 7,320,403 | B2 * | 1/2008 | May, Jr. | B65D 81/053 206/320 |
| 10,029,818 | B2 * | 7/2018 | Kelly | B65D 19/44 |

* cited by examiner

APPLIANCE PACKAGING SYSTEM AND METHOD

TECHNICAL FIELD

Exemplary embodiments relate to household appliances. Specifically exemplary embodiments relate to packaging systems and methods for transport of household appliances such as microwave ovens.

BACKGROUND

Household appliances are manufactured at a factory and then must be shipped to a retail store or other location. Sometimes such appliances are shipped to a facility where they are to be installed in apartment or dormitory units. The appliances must be packaged at the factory so that the risk of damage during transit and storage is reduced. For small appliances such packaging may include housing each appliance unit in an individual cardboard box along with suitable packing materials. A plurality of the appliance holding boxes are then arranged on a pallet or other supporting device and enclosed within external packaging for transport. Such external packaging may include cardboard covers and stretch plastic wrapping in order to hold the unit boxes together and in engagement with each other and the pallet. Numerous pallets may be packed in shipping containers, trucks, rail cars or other suitable devices for shipment to locations such as warehouses from which the pallets are distributed to other facilities such as retail stores, construction sites and the like.

Upon arrival at a retail store or other location, the external packaging must be removed to access the individual unit box packaging. The unit box packaging often remains with the individual unit until it reaches a consumer's home or other location where the unit is to be installed and operated. At the point of use, the packaging associated with the individual unit must then be removed and discarded. Because the appliance unit is held within an opaque box until reaching the point of installation, it is possible that the unit may differ from a demonstration unit that a consumer has seen and/or the illustrations of the particular unit which are shown on the packaging. Sometimes when this occurs, the unit must be repackaged by the purchaser and returned to the retail store or other establishment from which it was obtained.

Existing appliance packaging systems and methods may benefit from improvements.

SUMMARY

Exemplary embodiments include packaging for household appliances that protect the appliances from damage during shipment. Exemplary embodiments reduce the amount of packaging waste that must be discarded either at a retail location or construction site to which retail appliances are shipped. Exemplary embodiments further reduce the amount of packaging material that must be discarded at the point of use of the appliance. In addition, exemplary embodiments enable a purchaser or other user to see the appliance in the unit package before it is purchased and/or transported to the point of use, so there is less likely to be any confusion as to the nature of the appliance or dissatisfaction due to the appliance unit not conforming to the appearance of samples or other descriptive information after the unit is transported to its point of use. Exemplary embodiments also provide improved methods for packaging and unpackaging of household appliances or other items.

DETAILED DESCRIPTION

Figure 1:
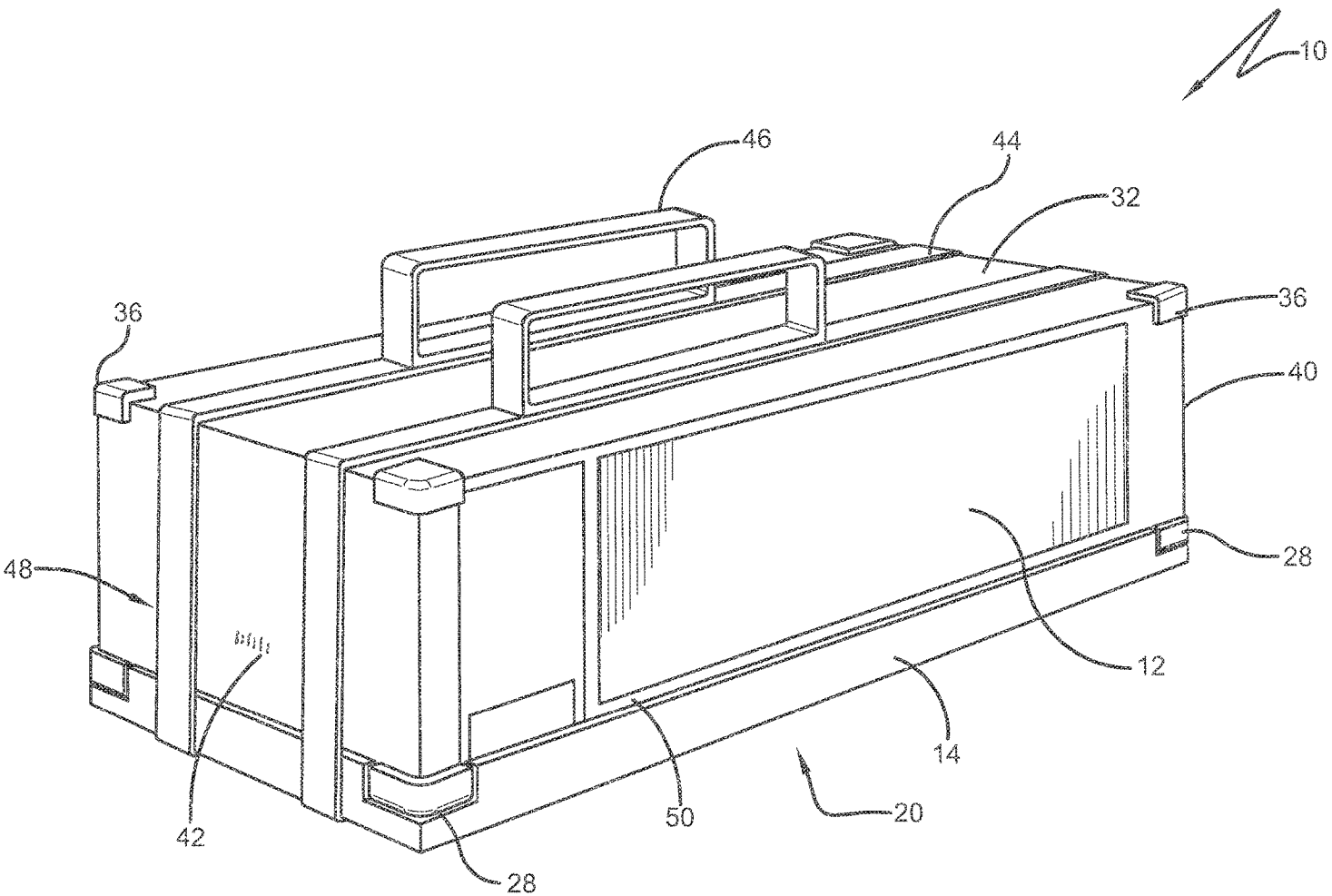
FIG. 1 is a front top perspective view of a household appliance comprising a microwave oven in exemplary unit packaging.

Referring now to the drawings and particularly to FIG. 1, there is shown therein a unit package generally indicated 10. The unit package includes an appliance 12. In the exemplary embodiment the appliance comprises a microwave oven. However, in other embodiments the appliance may include a different type of device.

Figure 2:
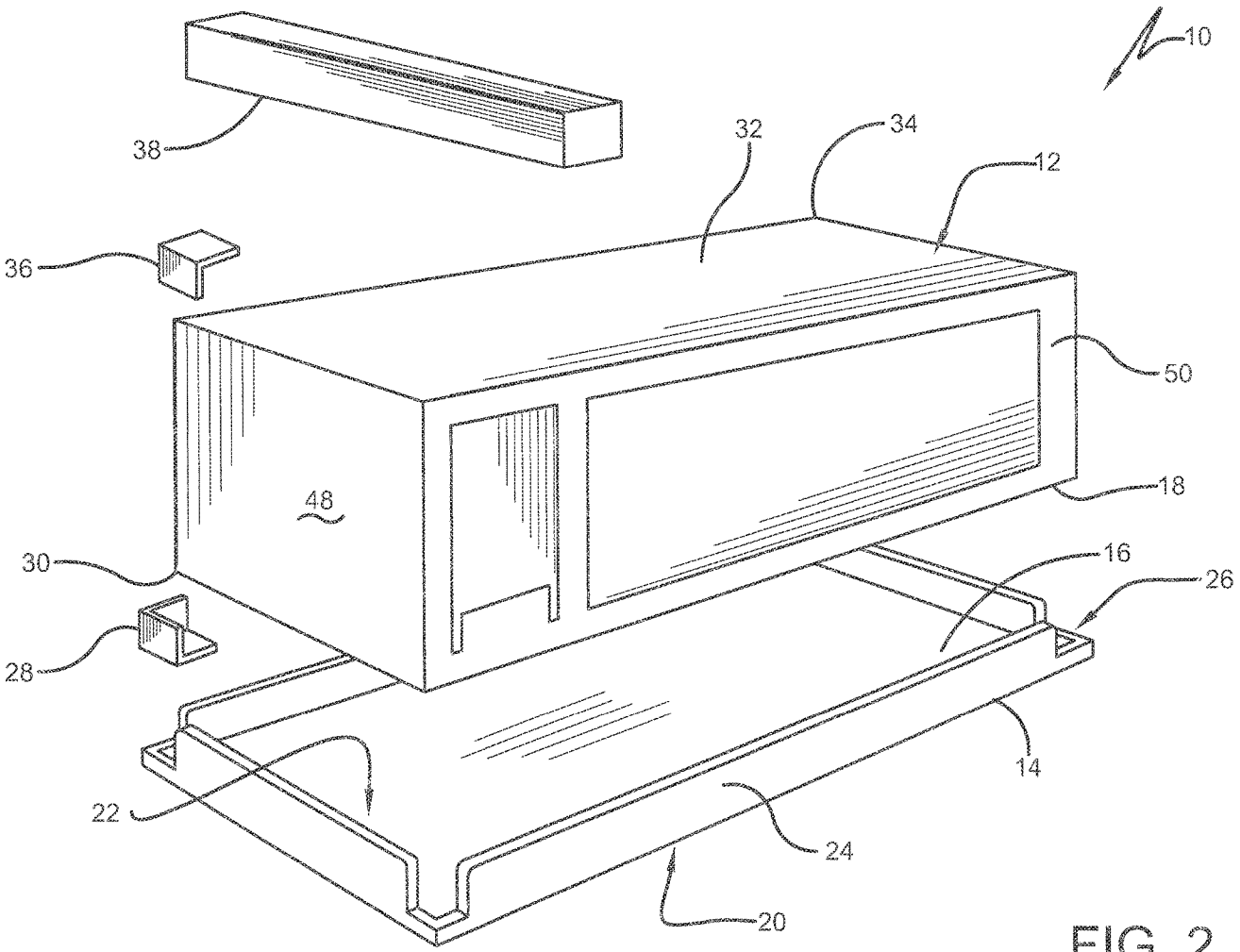
FIG. 2 is an exploded view of the appliance and certain packaging components shown in FIG. 1.

In the exemplary embodiment, the unit package 10 includes a base 14. The exemplary base is comprised of impact absorbent materials. Such impact absorbent materials in some embodiments may include a rigid or semi-rigid deformable foam material or other suitable support material. As shown in FIG. 2, the base 14 includes a base top side 16. The base top side 16 is operative to support a bottom side 18 of the appliance 12. The base 14 further includes a base bottom side 20 opposed of the base top side 16. In some exemplary embodiments the base may be comprised of plastics such as polystyrene, polyurethane. polyethylene, polypropylene, starch based polymers or biodegradable polymers. In other exemplary embodiments the base may be comprised of formed cellulose, layered sheets of cardboard or other materials which provide sufficient rigidity to support the appliance and energy absorption and/or force spreading or dissipation to protect the bottom side of the appliance.

In the exemplary embodiment the base top side includes a rectangular base recess 22. The exemplary base recess is configured to receive therein the bottom side of the microwave oven while supporting the microwave oven on the base top side surface. The base recess is bounded by a generally rectangular base wall 24. Each corner of the base recess includes a cutout 26. Each cutout is configured to receive a corner protection pad therein. In an exemplary embodiment, four lower corner protection pads 28 overlie each of the four appliance lower corners 30 to prevent damage thereto. In the exemplary embodiment, the protection pads 28 comprise a rigid or semi-rigid impact absorbent foam material or other material that is operative to protect the underlying corner of the appliance from deformation or damage in the event that the unit package is dropped on the corner pad. The materials used for the protection pads in exemplary embodiments may include those discussed above that may be used for the base. In some exemplary arrangements different materials may be used for the protection pads and the base, while in other embodiments the same materials may be used for both components. Of course these approaches are exemplary and in other embodiments, other approaches may be used.

The exemplary appliance includes an appliance top side 32. The appliance top side includes four upper corners 34. In the exemplary embodiment, upper corner protection pads 36 overlie each of the upper corners 34. In exemplary embodiments, the upper corner protection pads 36 may be similar to the lower corner protection pads 28 and may cover only the corner area. Alternatively in some arrangements, the upper or lower corner protection pads that overlie the corners may include an elongated cover such as for example alternative corner protection pads 38 shown in FIG. 2. The alternative corner protection pads may be a unitary structure that overlies a pair of disposed upper corners and also protects an elongated edge of the appliance top side 32 between the corners. Of course these approaches are exemplary and in other embodiments, other types of protection structures may be utilized.

In an exemplary embodiment, a transparent flexible plastic liner 40 extends in surrounding relation of the appliance 12. In the exemplary embodiment, the liner is in close fitting relation to the top side, bottom side and other walls of the appliance. The exemplary liner 40 extends between the bottom appliance side 18 and the base top side 16. However, in other exemplary embodiments the flexible plastic liner may surround the appliance and the base including the bottom side of the base 20. In the exemplary embodiment, the liner comprises a generally clear transparent plastic polymer so that the appliance within the unit package can be viewed from the exterior thereof. In some embodiments clear polymers such as, but not limited to, low density polyethylene and high density polyethylene may be used. In addition, as shown in FIG. 1, liners of exemplary embodiments may include visible indicia 42 printed or otherwise included thereon or attached thereto. The visible indicia may include, for example, a brand name, a model number, UPC code. QR code or other information that identifies the particular appliance type included in the unit package. In exemplary arrangements, the visible indicia is positioned on the liner to overlie an appliance surface having a color or configuration that allows the visible indicia to be readily viewed by an individual looking at the exterior of the unit package. Alternatively in some embodiments the visible, printed or other information may be on the appliance or on a label directly attached to the appliance, and readable visually or by a machine such as by a bar code reader, mobile device camera or other device, through the liner. Of course these approaches are exemplary and in other embodiments other approaches may be used.

In the exemplary arrangement the unit package 10 includes flexible straps 44. In the exemplary arrangement, the flexible straps are comprised of a relatively thick and tear-resistant material. Each of the straps 44 extend in surrounding relation of the appliance and the liner as well as the base 14. In the exemplary embodiment, a pair of disposed straps 44 extend in surrounding relation of the appliance and below the base bottom side 20. The straps are configured to have sufficient tautness, strength and durability to hold the base, appliance and liner in engagement. The exemplary straps are also of sufficient strength and durability to support the weight of the unit package. In some exemplary embodiments the straps may be comprised of suitable polymers, woven fiber materials, fiber reinforced materials or other suitable materials. It should be understood that while in the exemplary embodiment the straps extend externally of the base, in other embodiments the straps may extend through or terminate in attached engagement with the base.

In the exemplary arrangement, each of the straps 44 has integrally formed therein a flexible loop 46. Each flexible loop comprises a manually engageable handle that is in operative connection with a respective strap 44. In the exemplary embodiment, because the flexible loops are comprised of deformable material, the straps can be positioned flush against the strap of which the flexible loop is a part when the loop is not being used for carrying the appliance. However, when it is desired to manually carry the appliance, the flexible loops 46 may be opened as shown in FIG. 1. The flexible loops may be manually engaged by a person so that the unit package 10 can be readily manually carried. In other embodiments other types of handles that are integral with or releasibly engageable with the straps or the base may be used to carry the appliance.

In the exemplary embodiment, the appliance housing 48 includes an openable door 50. In the exemplary embodiment, because the door 50 or the adjacent housing structures may be subject to damage if they are subjected to excessive squeezing force applied by the straps 44, the straps are configured to extend in surrounding relation of the housing away from the side that includes the door. However, such an approach may not be necessary for other types of unit packages or other appliances. Thus for example in alternative embodiments the unit package straps may extend in different directions from that shown in FIG. 1 and/or in multiple different directions. Alternatively in some arrangements, the handles may be positioned in alternative positions such as on the vertical side or on the bottom of the unit package. Further, while the flexible loop handle structures are used in an exemplary embodiment, in other embodiments other types of handle structures may be used. These may include, for example, detachable handles that can be engaged with the straps, the base or other portions of the unit package. Other embodiments may include handles that can be selectively moved to engage different areas of the unit package for purposes of lifting and carrying the unit packages.

In exemplary embodiments the single appliance unit packaging avoids having a disposable box, such as a cardboard box, that surrounds each individual appliance unit. In exemplary embodiments no disposable single unit appliance containing box extends between the appliance and the base. Further no single appliance unit containing box extends in surrounding relation of the appliance individually. By avoiding having such an individual disposable box associated with each individual appliance unit, the exemplary embodiments avoid the need which exists with some current appliance packaging to dispose of considerable packaging materials such as a surrounding cardboard box. Packaging materials internal to the box such as spacers, internal filler materials between the outer box and the appliance, formed appliance holding sleeve structures within an outer cardboard box, and other packaging materials that would have to be removed and disposed of after the appliance is unpacked at the point of use, are generally not needed in exemplary embodiments.

Further in some exemplary embodiments the base, liner, straps, protection pads and other associated individual appliance unit packaging materials may be comprised of recyclable plastic or other materials. Such materials may be suitable for including in standard recycling processes to avoid the need for landfill disposal. Further exemplary embodiments may have one or more of such items comprised of readily biodegradable materials so that such materials may be disposed of in an environmentally friendly manner. Of course these approaches are exemplary and in other embodiments other approaches may be used.

Figure 3:
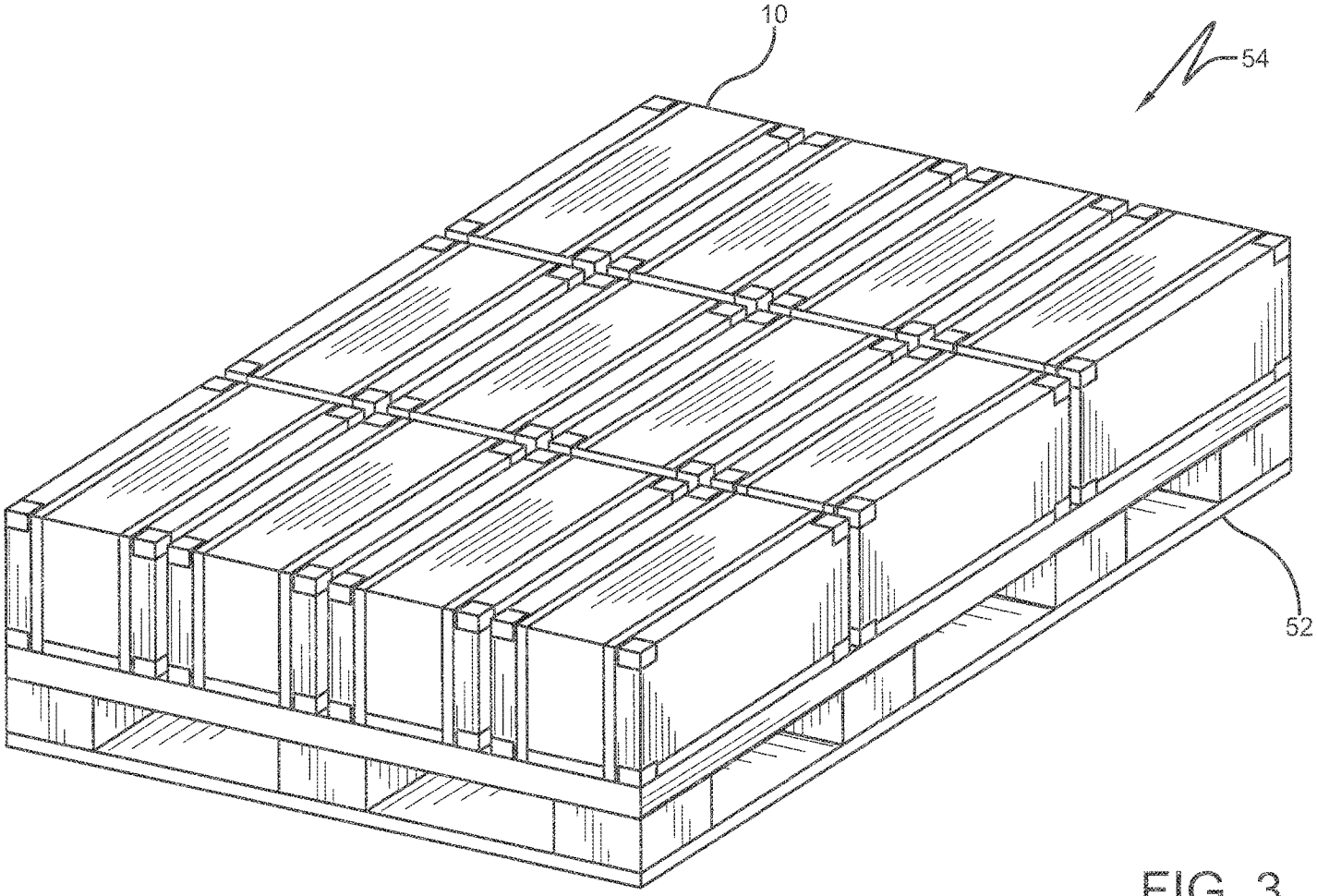
FIG. 3 is a perspective view of a plurality of appliances in unit packaging arranged in rows on a supporting pallet.

In an exemplary embodiment, the unit packages may be transported bundled together such that a plurality of appliance units are shipped together as a single shipping unit. For example, as shown in FIG. 3, unit packages 10 may be arranged in side-by-side rows and supported on a pallet 52. Pallet 52 may be a wooden or plastic pallet. Alternatively the pallet 52 may be another type of supporting structure that is suitable for supporting the quantity of unit packages required to be shipped together in a single unit. In the exemplary embodiment shown in FIG. 3, a layer 54 of unit packages 10 is made up of four rows of three unit packages each. Each unit package is in contacting engagement with at least two other unit packages in this configuration. Of course it should be understood that this arrangement is merely exemplary and numerous other different configurations may be utilized depending on the number of units to be shipped together in a particular shipping package.

Figure 4:
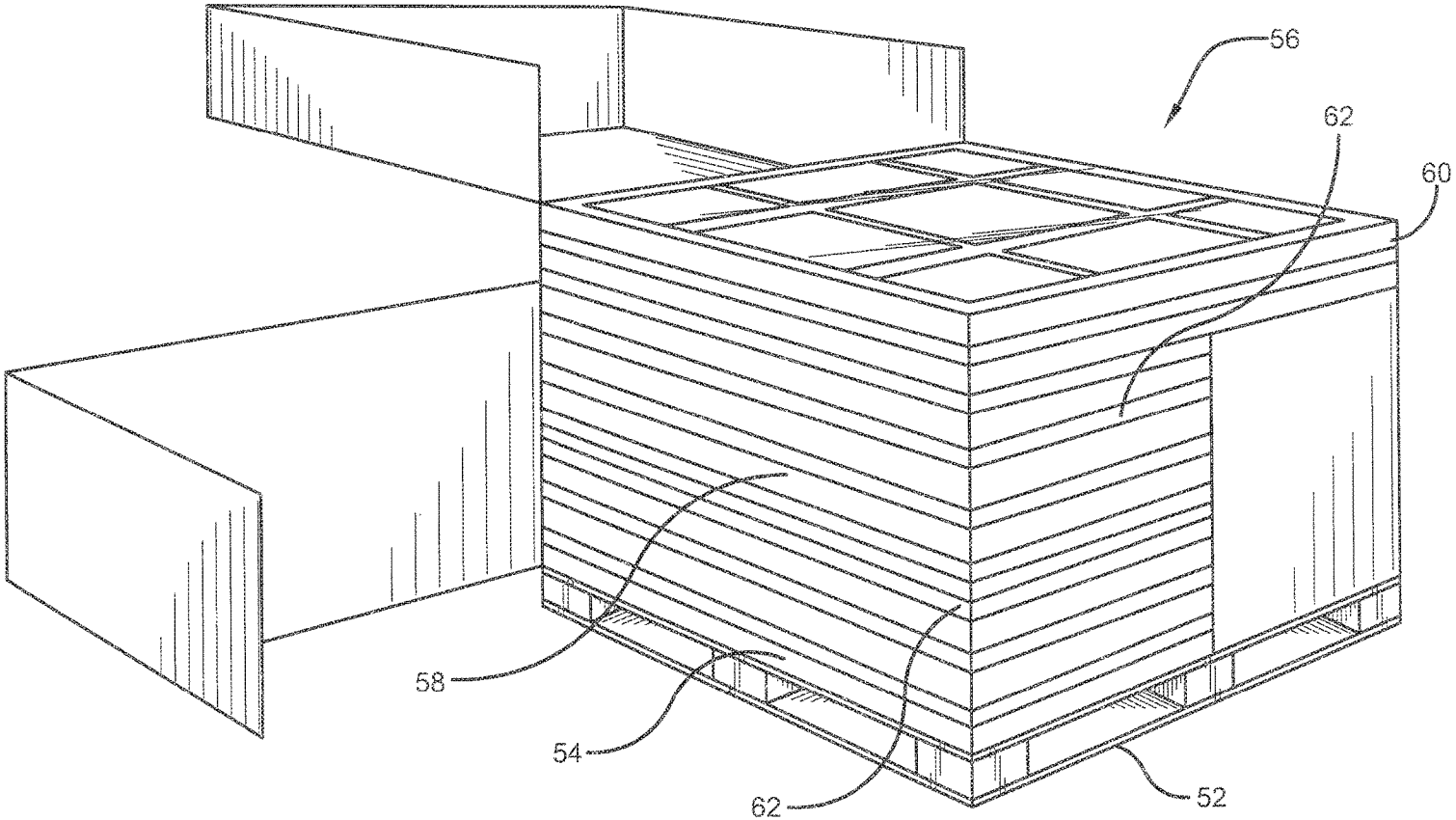
FIG. 4 is a perspective view of a rectangular stack including a plurality of unit packages arranged in a plurality of layered rows on a pallet, and a cardboard sleeve in an open position that is used to externally cover the stack.

As shown in FIG. 4, an exemplary stack 56 of unit packages is shipped together in supporting connection with the pallet. In this exemplary stack, a layer 58 of unit packages is positioned above layer 54 and a layer 60 is positioned above layer 58. In the exemplary packaging, separator sheets which are alternatively referred to herein as slip sheets 62 are positioned between layer 54 and layer 58 as well as between layer 58 and layer 60. In the exemplary embodiment the separator sheets are comprised of multilayer cardboard material. However, in other embodiments other approaches and materials may be used. Further in some arrangements a cover sheet may be positioned above layer 60 so as to protect the top surface of the unit packages therein. Further in some embodiments the stack 56 may be wrapped with a stretch wrap about its periphery so as to help assure the integrity thereof. However, in other arrangements such stretch wrapping of the stack may be unnecessary. Numerous different approaches may be taken depending on the size and nature of the appliances or other units that are included in the unit packages.

In the exemplary embodiment, during shipment the stack 56 is covered by a sleeve 64. Sleeve 64 is shown separate from the stack in FIG. 5 to facilitate showing its components and features. In the exemplary arrangement, the sleeve is comprised of double wall cardboard sheet 66 which is shown in cross section. However, in other embodiments, other materials may be used.

Figure 5:
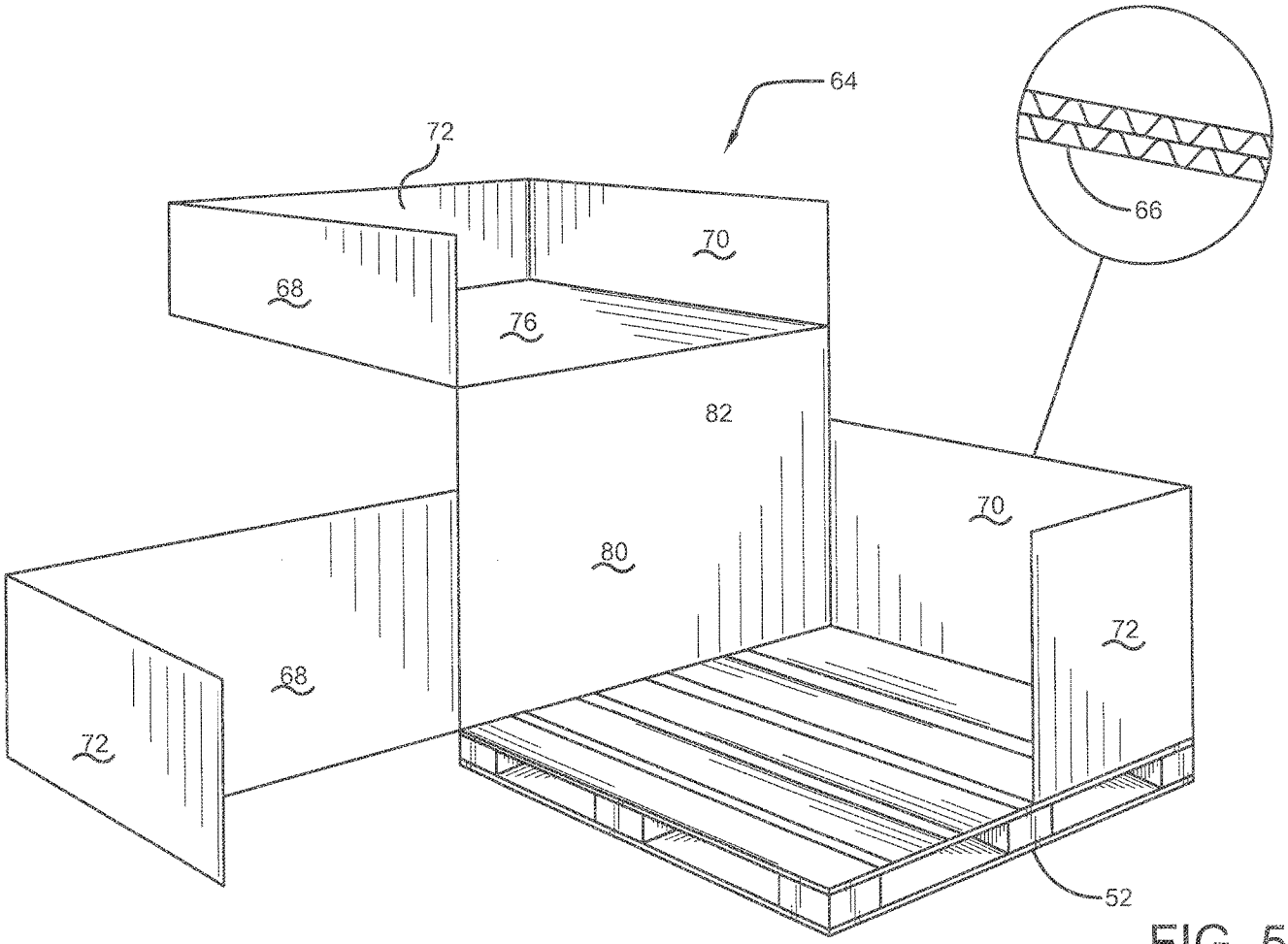
FIG. 5 is a view of the pallet and sleeve of FIG. 4 shown without the stack supported on the pallet for purposes of showing the sleeve structural details.
Figure 6:
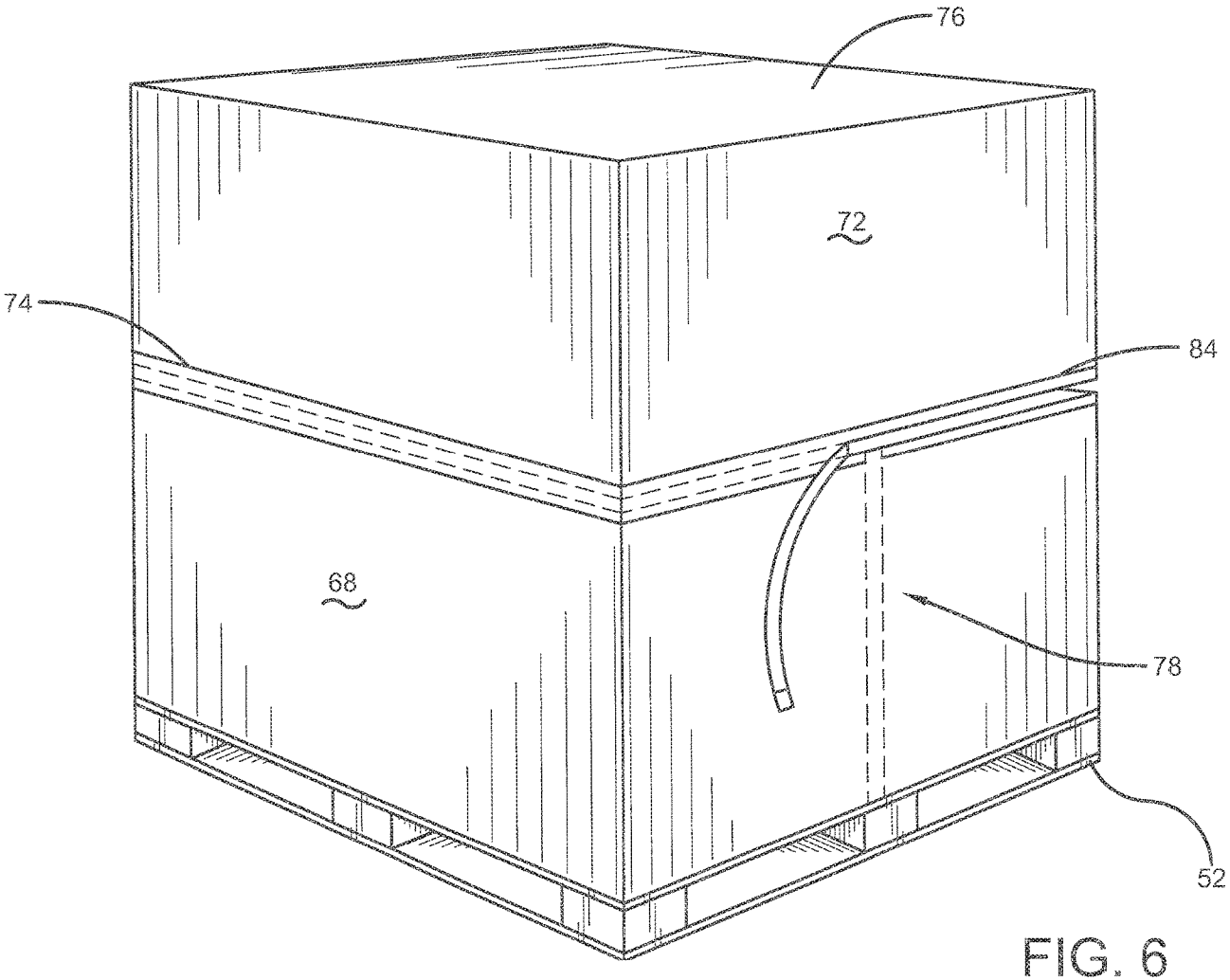
FIG. 6 is a perspective view of the pallet and sleeve in a closed position covering the stack.

In the exemplary arrangement, the sleeve 64 is comprised of three sides 68, 70 and 72 (see FIG. 5). As shown in FIG. 6, sleeve sides 68, 70 and 72 have a continuous horizontal slit 74 that separates the sides at approximately two third of the vertical height thereof from the pallet. The sleeve 64 further includes a sleeve top 76 which is sized to overlie the top of the stack. Side wall 72 further includes a vertical slit 78 therein. The vertical slit 78 extends intermediate of the horizontal slit 74 and the bottom of wall 72 adjacent the pallet 52. It should be understood that although only one of the side walls as shown includes a vertical slit, in other embodiments other side walls or sleeve walls may include features of this type.

In the exemplary arrangement, the sleeve 64 includes a continuous side wall 80. The continuous side wall 80 includes a scored edge 82. Scored edge 82 extends above the level of the horizontal slit 74 and generally at the level of the top 76. Further in exemplary embodiments, scored edges may also extend at the points where the folds of the sleeve are provided. Of course these approaches are exemplary and in other embodiments other approaches may be used.

As shown in FIG. 6, in the exemplary arrangement during shipment, the sleeve top 76 and the upper portions of walls 68, 70 and 72 are rotatably positioned about the scored edge 82 so as to extend above the stack 56. To hold the portions of the sleeve in position, a frangible adhesive strip 84 is positioned in overlying relation of both sides of the horizontal slit 74. The frangible adhesive strip 84 extends on both sides of the slit 74 to hold the slit closed and the wall portions in close adjacent relation. In the exemplary arrangement a further frangible adhesive strip 86 is used to close vertical slit 78 as shown in FIG. 7.

Figure 9:
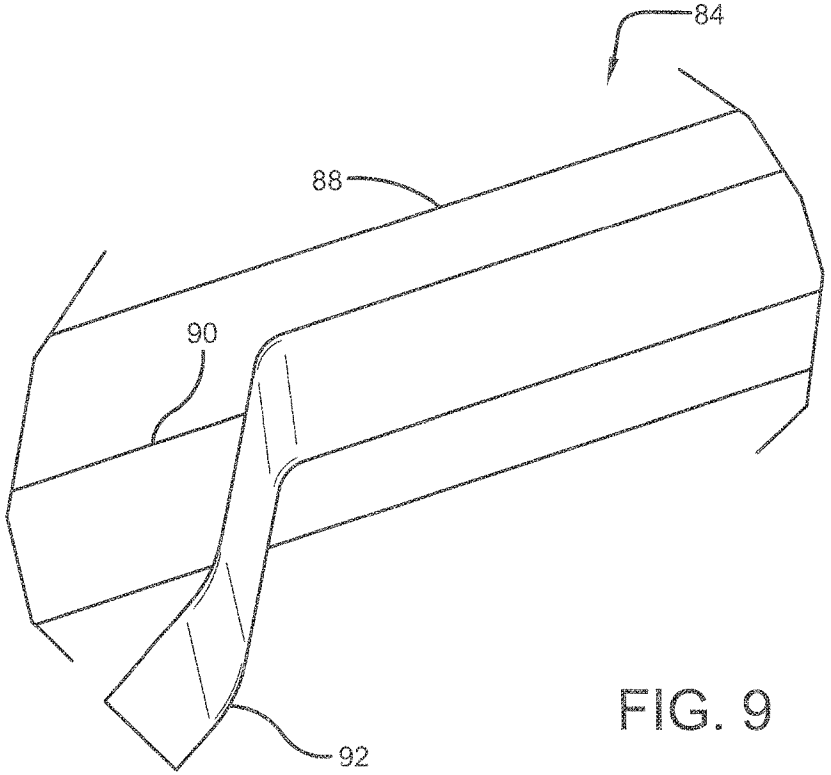
FIG. 9 is a perspective view of a portion of a frangible adhesive strip with a peel off tape that can be used to releasibly hold an exemplary sleeve structure in its assembled condition.

In exemplary embodiments, the frangible adhesive strip includes a web 88 of suitable plastic material that includes a contact adhesive on its inward facing surface that engages the outside surface of the sleeve. As shown in FIG. 9, the exemplary web includes a break line 90 at the midpoint thereof. The break line 90 may be fully perforated or partially perforated so as to readily separate the portions of the web on either side of the break line. An overlying peel off tape 92 extends on the external side of the web 88. The peel off tape includes an inward facing adhesive that holds it in releasible engaged relation with the web 88. The peel off tape 92 helps to hold the two sides of the web together when it is in attached relation thereto. This is the position of the frangible adhesive strip during shipment. When it is desired to open the sleeve to access the unit packages, the peel off tape 92 is pulled away from the web and the sides of the web can then be separated. In some embodiments removal of the peel off tape may cause the web to be generally fully separated at the break line while in other exemplary embodiments the break line may be fully readily separated by cutting or deformation after the peel off tape is removed. As can be appreciated, the exemplary frangible adhesive strip is applied such that the break line 90 of the web is generally aligned with the underlying slit in the sleeve. Of course it should be understood that this approach is exemplary and in other embodiments, other approaches and materials may be used.

Figure 7:
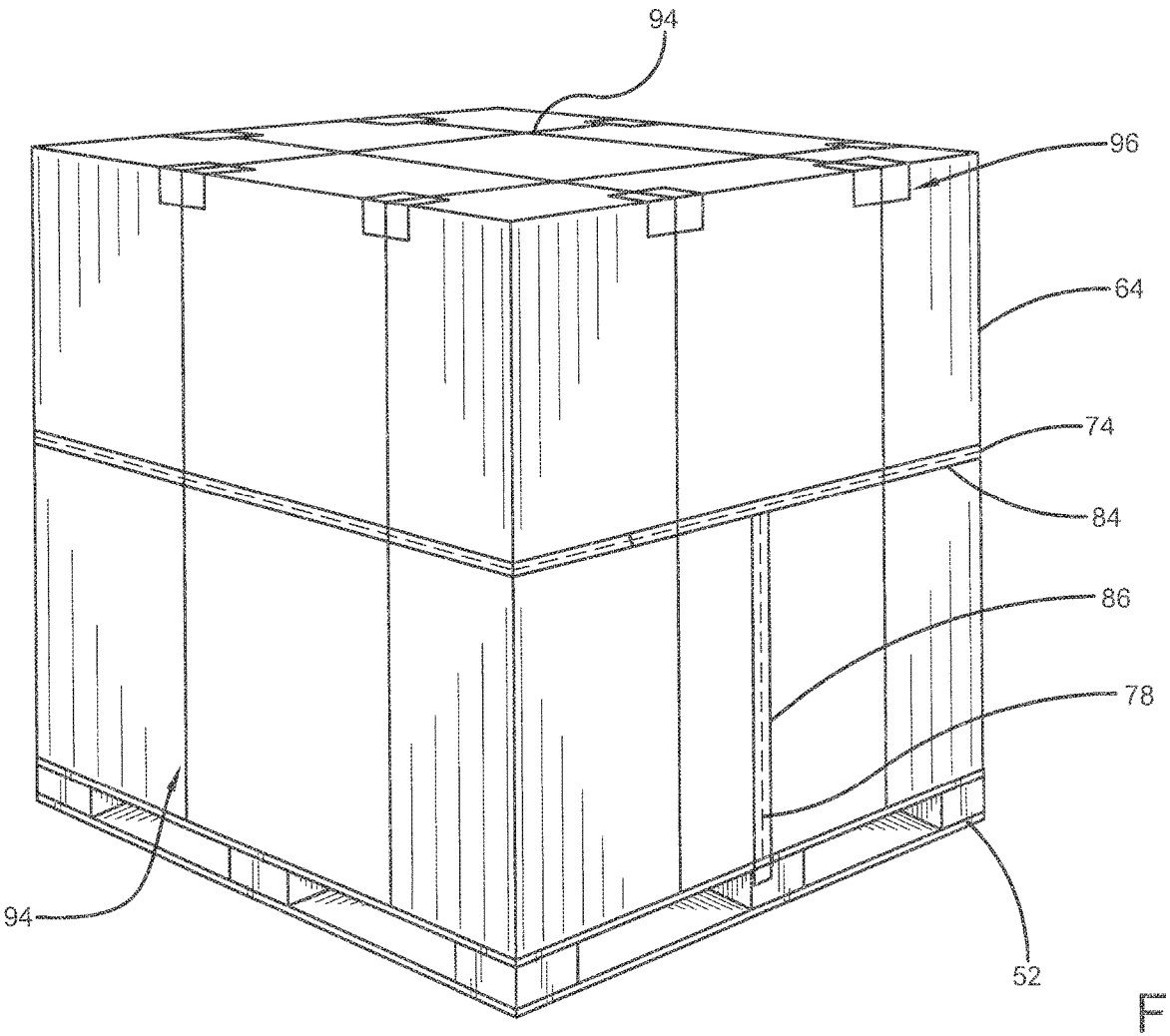
FIG. 7 is a perspective view of the sleeve in a closed position and surrounded by a plurality of external straps and strapping protectors which hold the stack, sleeve and the pallet in fixed engagement.

As shown in FIG. 7 in the exemplary arrangement, the stack of unit packages is shipped with the sleeve 64 closed and extending in surrounding relation of the stack. With the sleeve closed and in surrounding relation of the stack, a plurality of external straps 94 extend in surrounding relation of the sleeve, the stack and the pallet 52. In the exemplary arrangement, the external straps 94 extend in different directions which are generally perpendicular to one another across the top of the sleeve to further help to hold the packaging together and to reduce the risk of shifting in all directions. Further in the exemplary arrangement, strapping protectors 96 extend in underlying relation of the external straps. In the exemplary arrangement, the strapping protectors extend in overlying relation of the sleeve top 76. The strapping protectors are sufficiently rigid and energy absorbent so as to avoid damaging force from being applied to the appliances in the unit packaging below the sleeve top. The number of external straps 94 which are applied may vary in different embodiments so as to provide sufficient support and maintain package integrity under the expected normal shipping conditions encountered during transit.

In the exemplary arrangement, in order to produce the packaging for shipment, each appliance is housed in a unit package 10. This is accomplished by placing the upper and lower corner protection pads 28, 36 at the corners of the appliance. The liner 40 is then placed in close fitting surrounding engagement with the appliance housing. The appliance surrounded by the liner is then placed in engagement with the base 14 such that the bottom side of the appliance extends in the rectangular base recess 22. The straps 44 including the flexible loop handles 46 are then extended in surrounding relation of the appliance and the impact absorbent base so as to secure the appliance, the liner and the base in engaged relation.

In the exemplary arrangement, the unit packages each include one appliance and are placed in rows in supporting connection with the pallet. The unit packages are positioned with the base side down and the handles comprised of the flexible loops positioned upward. The appliances are arranged in adjacent rows so as to form layers of unit packages supported on the pallet. In the exemplary arrangement, each layer is separated by a separator sheet of cardboard. The exemplary sleeve is then brought into adjacent relation with the stack that is formed by the layers of unit packages. The sleeve is then closed and the horizontal and vertical slits in the sleeve side walls held closed through the application of the frangible adhesive strips. Thereafter the external straps 94 and strapping protectors 96 are extended about the sleeve and the pallet so as to hold the components included in the packaging in engaged adjacent relation and suitable for transport.

Figure 8:
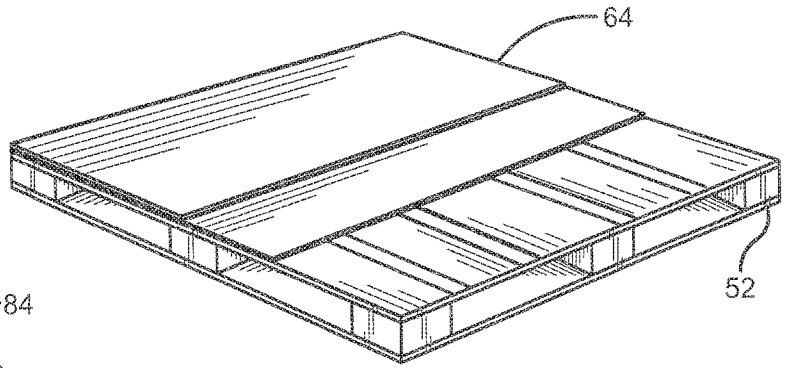
FIG. 8 is a perspective view of an exemplary pallet showing the exemplary sleeve structure folded flat and supported thereon.

In the exemplary arrangement after the pallet has reached its destination, unpacking is accomplished by cutting or otherwise removing the external straps 94. The horizontal slit is opened by pulling off the peel off tape from the frangible adhesive strip. Likewise the vertical slit is opened by pulling off the peel off tape from the frangible adhesive strip thereon. This enables the sleeve to be separated and removed from the stack and the pallet. In the exemplary arrangement, the sleeve can be folded into a flat position and placed on top of the pallet for return or recycling. This is represented for the exemplary embodiment in FIG. 8.

As can be appreciated in the exemplary embodiment with the sleeve 64 wholly or partially removed from the stack, the unit packages can be removed therefrom by manually picking up the unit packages through manual engagement with the flexible loops. Therefore warehouse workers who need to move the unit packages and/or workers who need to move the appliances can readily do so by engaging the straps on the unit packages. Alternatively, consumers who may purchase the appliances in a retail environment may pick up the appliance units with the straps and place them in a cart or other device so as to transport them to a point of checkout. In exemplary arrangements, the appliance is visible through the transparent liner which enables the person who views the unit package to determine the appearance, nature and properties of the appliance positioned therein. As a result, the individual can see the unit and is less likely to select a unit that is unsuitable in color, size or configuration for their desired purposes. Further in exemplary arrangements because the unit packaging does not involve an intermediate box such as a cardboard box that surrounds the unit intermediate of the appliance and its supporting base, the amount of material that needs to be discarded once the appliance reaches its point of use may be less than with other types of packaging. Thus the exemplary arrangement avoids the need for a surrounding box and other packing material which would otherwise have to be disposed of when the unit reaches its final destination. Of course the features described are of the exemplary embodiments and in other arrangements, other features, constructions and elements may be utilized.

While exemplary embodiments have been described in connection with packaging for appliances which comprise microwave ovens, the principles described may be applied to packaging for other types of appliances. Such appliance may include other types of household appliances, such as dehumidifiers, compact refrigerators, compact washing machines, compact clothes dryers, compact dishwashers, toasters, toaster ovens and other similar units. The principles hereof may also be applied to non-household units. Further while exemplary embodiments may particularly be useful for appliances having generally rectangular shapes, appliances and other devices having other shapes may also utilize the principles and structures described herein, particularly for items which shapes that have at least two generally parallel disposed surfaces that may make such individual units amenable to being arranged in stacked relation. Numerous packaging structures and arrangements may be implemented for numerous types of structures based on the teachings provided herein.

Thus the exemplary embodiments described can achieve improved operation and capabilities, eliminate difficulties encountered in the use of prior apparatus and methods and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features shown and described.

Further in the following claims any feature described as a means for performing a function shall be construed as encompassing any means known to those skilled in the art as being capable of carrying out the recited function and shall not be deemed limited to the particular means shown or described for performing the recited function in the foregoing description or mere equivalents thereof.

Having described the features, discoveries and principles of the exemplary embodiments, the manner in which they are constructed and operated, and the advantages and useful results attained, the new and useful structures, devices, elements, arrangements, parts, combinations, systems, equipment, operations, methods, processes and relationships are set forth in the appended claims.

I claim:

1. An apparatus comprising:

a household appliance, packaging for the household appliances including:

a single appliance unit package including a base, wherein the base is comprised of impact absorbent material, wherein the base includes a base top side, a base bottom side, wherein the base top side is configured to operatively support an appliance bottom side of the appliance, a generally transparent flexible liner,
wherein the liner extends in generally surrounding relation of the appliance,
wherein no single appliance surrounding disposable box
extends between the liner and the appliance or the base and the appliance, or
in surrounding relation of the appliance individually,
at least one strap,
wherein the at least one strap extends in surrounding relation of the appliance and the liner, and is in operative connection with the base,
wherein the at least one strap is operative to hold the liner, the appliance and the base in operative fixed engaged relation,
at least one handle,
wherein the at least one handle is in operative connection with the at least one strap,
wherein the at least one handle is configured to enable the unit package including the appliance, base and liner to be manually carried by the at least one handle.

2. The apparatus according to claim 1
wherein the at least one handle includes at least one flexible loop.

3. The apparatus according to claim 2
wherein a respective flexible loop is integral with a respective strap and is positioned adjacent to a top appliance side, wherein the top appliance side is generally opposed of the bottom appliance side.

4. The apparatus according to claim 2
wherein the base top side includes a base recess, wherein the bottom appliance side extends in the base recess.

5. The apparatus according to claim 4
wherein the base recess is generally rectangular and includes four base recess corners,
wherein the base recess is bounded by a generally rectangular base wall,
wherein the base wall includes a respective cutout in each respective base recess corner,
wherein the bottom appliance side has a generally rectangular shape and the appliance includes four lower corners,
wherein the unit package includes a plurality of lower corner protection pads,
wherein a respective lower corner protection pad overlies each respective lower corner,
wherein each lower corner protection pad extends in a respective cutout.

6. The apparatus according to claim 5
wherein the unit package includes four lower protection pads, wherein each lower protection pad overlies one respective lower corner and extends in a respective cutout.

7. The apparatus according to claim 5
wherein the appliance includes a housing having four upper corners,
wherein the unit package includes a plurality of upper protection pads, wherein an upper protection pad overlies each upper corner.

8. The apparatus according to claim 7
wherein the unit package includes four upper protection pads, wherein one upper protection pad overlies one respective upper corner.

9. The apparatus according to claim 7
wherein the at least one strap includes at least two parallel straps.

10. The apparatus according to claim 9
wherein each of the at least two straps extends on the base bottom side.

11. The apparatus according to claim 9
wherein the liner includes visible indicia, wherein the visible indicia includes at least one of a brand, a model, a UPC code, and a QR code corresponding to the appliance.

12. The apparatus according to claim 11
wherein the appliance includes a microwave oven, wherein the microwave oven includes a door, and wherein neither of the at least two straps overlie the door.

13. The apparatus according to claim 9
wherein visible indicia is applied to the appliance, wherein the visible indicia includes at least one of a brand, a model, a UPC code and a QR code corresponding to the appliance,
wherein the visible indicia is at least one of human readable and machine readable through the liner.

14. The apparatus according to claim 7 and further comprising
a pallet,
a plurality of unit packages each including a respective household appliance in stacked supported operative engagement with the pallet.

15. The apparatus according to claim 14 wherein the plurality of unit packages are arranged above the pallet in a plurality of horizontal rows,
wherein each base is positioned below each appliance and each unit package is in abutting adjacent relation horizontally with at least two other unit packages.

16. The apparatus according to claim 15
wherein the plurality of unit packages are arranged above the pallet in a plurality of disposed vertical layers, wherein each layer comprises a plurality of horizontal rows of unit packages.

17. The apparatus according to claim 16
wherein at least one separator sheet extends between at least two of the layers.

18. The apparatus according to claim 17
wherein a plurality of rows and a plurality of layers of unit packages positioned above the pallet define a generally rectangular stack of unit packages,
wherein the stack has a top and four sides above the pallet,
and further comprising a cardboard sleeve overlying the top and four sides of the stack.

19. The apparatus according to claim 18
wherein the cardboard sleeve includes a sleeve top and four vertically extending sleeve sides,
wherein three contiguous sleeve sides include a continuous horizontal slit,
wherein the continuous horizontal slit is positioned vertically intermediate of the pallet and the sleeve top,
wherein the horizontal slit is configured to enable the sleeve sides above the slit and the top to be rotated to cover and uncover the top of the stack,
wherein the sleeve includes a fourth sleeve side that does not include the horizontal slit and wherein the sleeve top is rotatable relative to the fourth sleeve side.

20. The apparatus according to claim 19
wherein the fourth sleeve side includes a generally horizontal scored edge,
wherein the scored edge is generally in alignment with the sleeve top, and
wherein the sleeve top and the three sleeve sides above the horizontal slit are rotatable about the scored edge.

21. The apparatus according to claim 20 and further including:

a horizontal frangible adhesive strip, wherein the horizontal strip overlies at least a portion of the horizontal slit, wherein the horizontal strip is operative to hold the horizontal slit closed and is frangible to enable selectively opening the horizontal slit.

22. The apparatus according to claim 21 wherein the horizontal strip includes a peel off tape, wherein removal of the peel off tape enables releasibly separating the horizontal strip, and wherein the horizontal strip is in generally aligned relation with the horizontal slit.

23. The apparatus according to claim 22 and further including:

a vertical slit extending in one of the sleeve sides below the horizontal slit, wherein the vertical slit extends generally from the horizontal slit to the pallet, wherein with the horizontal strip separated, the vertical strip enables foldably opening and moving away from the stack, the sleeve side below the horizontal slit.

24. The apparatus according to claim 23 wherein the vertical slit extends in the sleeve side opposite the fourth sleeve side.

25. The apparatus according to claim 24 wherein a vertical frangible adhesive strip overlies the vertical slit, wherein the vertical strip is operable to hold the vertical slit closed and is frangible to enable selectively opening the vertical slit.

26. The apparatus according to claim 25 wherein the vertical strip includes a further peel off tape, wherein removal of the further peel off tape from the vertical strip enables readily separating the vertical strip, and wherein the vertical strip is in generally aligned relation with the vertical slit.

27. The apparatus according to claim 26 and further comprising:

a plurality of external straps, wherein each of the external straps is in operative engagement with the sleeve and the pallet, and wherein the plurality of external straps are operative to hold the sleeve, the stack and the pallet in fixed operative engagement.

28. The apparatus according to claim 27 and further comprising:

a plurality of strapping protectors, wherein the strapping protectors extend intermediate of the external straps and the sleeve.

29. An apparatus comprising:

a microwave oven, packaging for the microwave oven including:

a single microwave oven unit package including a base, wherein the base includes a base top side, an engaging recess extending on the base top side, a base bottom side, wherein the engaging recess on the base top side is configured to receive and operatively support a bottom side of the microwave oven, a generally transparent flexible liner, wherein the liner extends in generally surrounding relation of the microwave oven, wherein no single microwave oven containing disposable box extends between the liner and the microwave oven or the base and the microwave oven, or in surrounding relation of the microwave oven individually, at least one strap, wherein the at least one strap extends in surrounding relation of the microwave oven and the liner, and is in operative connection with the base, wherein the at least one strap is operative to hold the liner, the microwave oven and base in operative fixed engaged relation.

30. The apparatus according to claim 29, and further comprising at least one handle, wherein the at least one handle is integral with the at least one strap, wherein the at least one handle is configured to enable the unit package including the microwave oven, the base and the liner to be manually carried by the at least one handle.

31. An apparatus comprising:

a household appliance, packaging for the household appliances having a generally rectangular shape including:

a single appliance unit package including a base, wherein the base includes a base top side, a base bottom side, wherein the base top side is configured to operatively support an appliance bottom side of the appliance, a flexible plastic liner, wherein the liner extends in generally surrounding relation of the appliance, wherein no single appliance surrounding disposable box extends between the liner and the appliance or the base and the appliance, or in surrounding relation of the appliance individually, at least one strap, wherein the at least one strap extends in surrounding relation of the appliance and the liner, and is in operative connection with the base, wherein the at least one strap is operative to hold the liner, the appliance and the base in operative fixed engaged relation, at least one handle, wherein the at least one handle is in operative connection with the at least one strap, wherein the at least one handle is configured to enable the unit package including the appliance, the base and the liner to be manually carried by the at least one handle.

32. The apparatus according to claim 31 wherein the liner is generally transparent such that the appliance is visible therethrough.

* * * * *